US010675505B1

(12) United States Patent
Maresh

(10) Patent No.: US 10,675,505 B1
(45) **Date of Patent: *Jun. 9, 2020**

(54) EXERCISE METHODS AND APPARATUS

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 35 days.

This patent is subject to a terminal disclaimer.

(21) Appl. No.: 15/907,243

(22) Filed: Feb. 27, 2018

Related U.S. Application Data

(63) Continuation of application No. 15/145,688, filed on May 3, 2016, now Pat. No. 9,907,996, which is a continuation of application No. 13/855,703, filed on Apr. 2, 2013, now Pat. No. 9,339,685.

(60) Provisional application No. 61/686,206, filed on Apr. 2, 2012.

(51) Int. Cl.

| | |
|---|---|
| ***A63B 22/06*** | (2006.01) |
| ***A63B 22/04*** | (2006.01) |
| ***A63B 23/035*** | (2006.01) |
| ***A63B 22/00*** | (2006.01) |
| *A63B 21/00* | (2006.01) |
| *A63B 21/22* | (2006.01) |
| *A63B 21/015* | (2006.01) |

(52) U.S. Cl.

CPC ..... *A63B 22/0664* (2013.01); *A63B 22/001* (2013.01); *A63B 22/0015* (2013.01); *A63B 22/0017* (2015.10); *A63B 22/04* (2013.01); *A63B 23/03575* (2013.01); *A63B 21/00069* (2013.01); *A63B 21/015* (2013.01); *A63B 21/154* (2013.01); *A63B 21/225* (2013.01); *A63B 22/00* (2013.01); *A63B 2022/067* (2013.01); *A63B 2022/0676* (2013.01)

(58) Field of Classification Search

CPC . A63B 21/225; A63B 22/001; A63B 22/0015; A63B 22/06; A63B 22/0664; A63B 22/0017; A63B 22/0623; A63B 22/067; A63B 22/0676; A63B 22/0682; A63B 22/0688

USPC ..... 482/51–78

See application file for complete search history.

(56) References Cited

U.S. PATENT DOCUMENTS

| | | | | | |
|---|---|---|---|---|---|
| 4,940,233 | A * | 7/1990 | Bull | A63B 21/154 | 482/112 |
| 5,577,985 | A * | 11/1996 | Miller | A63B 21/00178 | 482/51 |
| 5,769,760 | A * | 6/1998 | Lin | A63B 22/001 | 482/51 |
| 5,868,650 | A * | 2/1999 | Wu | A63B 22/001 | 482/51 |
| 6,017,294 | A * | 1/2000 | Eschenbach | A63B 22/001 | 482/51 |

(Continued)

*Primary Examiner* — Joshua Lee
(74) *Attorney, Agent, or Firm* — Nick A. Nichols, Jr.

(57) ABSTRACT

An exercise apparatus may provide a novel linkage assembly suitable for linking circular motion to relatively more complex, generally elliptical motion. Left and right rocker links may be rotatably mounted on a frame rotatable about a first axis. Left and right rocker linkages may be mounted on the frame rotatable about a second axis. Left and right force receiving members may be movably connected between respective rocker links and rocker linkages in such a manner that the force receiving members move through paths of motion which are fixed, adjustable or variable.

15 Claims, 4 Drawing Sheets

(56) References Cited

U.S. PATENT DOCUMENTS 6,135,926 A * 10/2000 Lee ..... A63B 22/001 482/51
6,168,552 B1 * 1/2001 Eschenbach ..... A63B 22/001 482/51
6,575,877 B2 * 6/2003 Rufino ..... A63B 22/0664 482/51
7,060,005 B2 * 6/2006 Carlsen ..... A63B 22/001 482/52
7,153,239 B1 * 12/2006 Stearns ..... A63B 22/001 482/52
7,172,531 B2 * 2/2007 Rodgers, Jr. ..... A63B 22/001 482/52
7,513,854 B1 * 4/2009 Stearns ..... A63B 22/001 482/52
7,530,926 B2 * 5/2009 Rodgers, Jr. ..... A63B 22/001 482/51
7,591,761 B1 * 9/2009 Ellis ..... A63B 21/22 482/52
7,794,362 B2 * 9/2010 Miller ..... A63B 22/0017 482/52
7,828,698 B2 * 11/2010 Rodgers, Jr. ..... A63B 22/001 482/51
2004/0235621 A1 * 11/2004 Eschenbach ..... A63B 22/001 482/52
2005/0049117 A1 * 3/2005 Rodgers, Jr. ..... A63B 22/001 482/52
2005/0124466 A1 * 6/2005 Rodgers, Jr. ..... A63B 22/001 482/52
2005/0181911 A1 * 8/2005 Porth ..... A63B 22/001 482/52
2007/0179023 A1 * 8/2007 Dyer ..... A63B 22/0664 482/52
2008/0248928 A1 * 10/2008 Chu ..... A63B 22/001 482/52
2009/0069158 A1 * 3/2009 Hsu ..... A63B 22/001 482/52

* cited by examiner

EXERCISE METHODS AND APPARATUS

CROSS-REFERENCE TO RELATED APPLICATION

This application is a continuation of U.S. application Ser. No. 15/145,688, filed May 3, 2016, now U.S. Pat. No. 9,907,996, which is a continuation of U.S. application Ser. No. 13/855,703, filed Apr. 2, 2013, now U.S. Pat. No. 9,339,685, which claims the benefit of U.S. Provisional Application Ser. No. 61/686,260, filed Apr. 2, 2012, which applications are herein incorporated by reference in their entirety.

BACKGROUND

The present invention relates to fitness machines, and in particular fitness machines that constrain a user's feet and/or arms to travel along variable or fixed paths.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY

An exercise apparatus may provide a novel linkage assembly suitable for linking circular motion to relatively more complex, generally elliptical motion. Left and right rocker links may be rotatably mounted on a frame rotatable about a first axis. Left and right rocker linkages may be mounted on the frame rotatable about a second axis. Left and right force receiving members may be movably connected between respective rocker links and rocker linkages in such a manner that the force receiving members move through paths of motion which are fixed, adjustable or variable.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
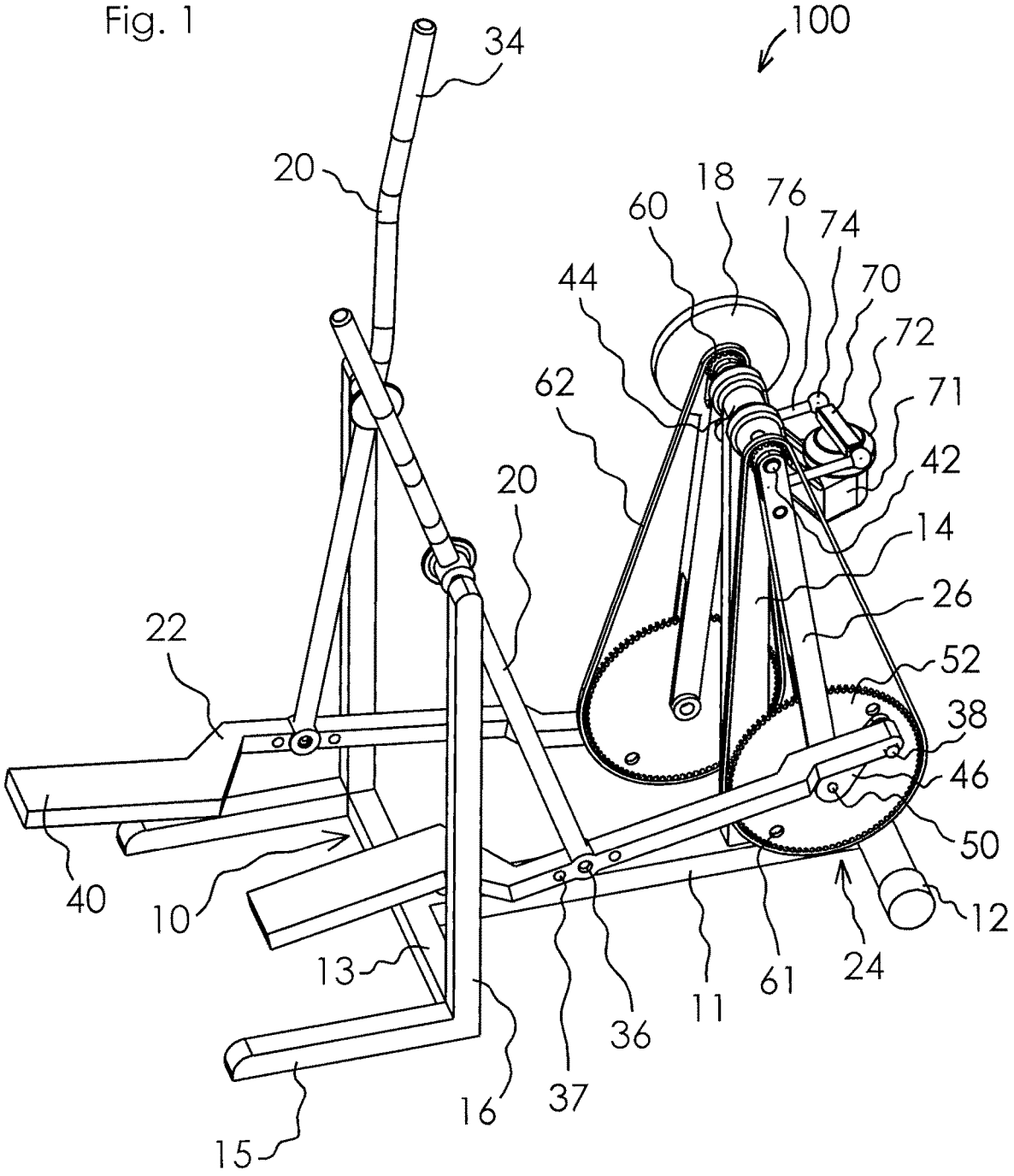
FIG. 1 is a perspective view of a first embodiment of an exercise apparatus.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, displacement of the cranks move the foot supports in a direction coincidental with one axis of the elliptical path, and displacement of crank driven members move the foot supports in a direction coincidental with the other axis. A general characteristic of elliptical exercise apparatus may be that the crank diameter determines the length of one axis, but does not determine the length of the other axis. As a result of this feature, a user's feet may travel through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. Like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a user can typically exercise on such apparatus while facing in either direction relative to the linkage assembly.

Referring first to FIG. 1, a first embodiment of an elliptical exercise apparatus is generally denoted by the reference numeral 100. The apparatus 100 includes a frame 10 that is designed to rest upon a floor surface. The frame 10 may include a generally I-shaped base that may include an elongate base member 11 and transversely oriented base members 12, 13 fixedly secured to the opposite ends of the base member 11. A forward stanchion 14 extends upward from proximate a forward end of the frame 10 and rearward stanchions 16 extend upward from proximate the distal ends of the transverse base member 13. Frame members 15 provide additional stability for the apparatus 100. The apparatus 100 is generally symmetrical about a vertical plane extending lengthwise through the frame 10, perpendicular to the transverse base members 12, 13, the only exceptions being a flywheel 18 and the relative orientation of certain parts of the linkage assembly on opposite sides of the plane of symmetry. Those skilled in the art will also recognize that the portions of the frame 10 which are intersected by the plane of symmetry exist individually and thus, do not have any "opposite side" counterparts. Moreover, although reference is made to forward and rearward portions of the apparatus 100, a user may exercise while facing toward either the front or rear of the frame 10.

A linkage assembly is mounted on each side of the apparatus 100. Each linkage assembly may generally include a handlebar rocker link 20, a force receiving link 22, a crank assembly 24, and a forward or active rocker link 26. The handlebar rocker link 20 is rotatably secured to a rear stanchion 16 at handle bars shaft 28. Friction disks and grip rings may be mounted between the handlebar rocker links 20 and the rear stanchions 16. Friction resistance may be adjusted by tightening or loosening the grip ring or other known means, such as a knob or the like. An upper end 34 of each rocker link 20 may be sized and configured for grasping by a user standing on the force receiving link 22.

A lower distal end of each handlebar rocker link 20 is rotatably connected at an intermediate region of a respective force receiving link 22 at bearing pin 36. A forward distal end of each force receiving link 22 is rotatably secured to a respective crank assembly 24 at bearing 38. Foot platforms 40 sized and configured to support a user's foot may be integrally formed with or rigidly secured to respective force receiving links 22.

Figure 2:
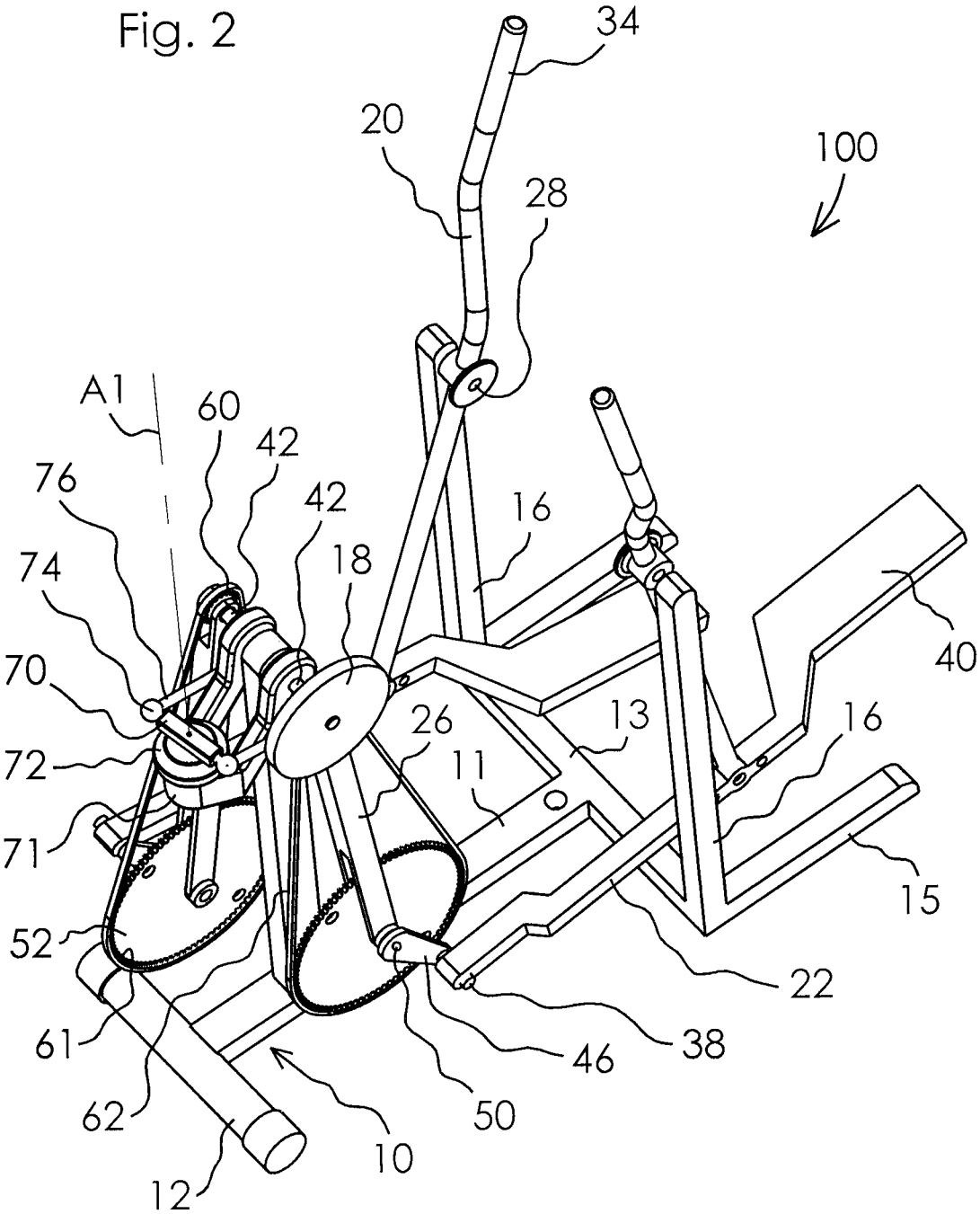
FIG. 2 is a perspective view taken from the opposite side of the exercise apparatus shown in FIG. 1.

Referring now to FIG. 2, each crank assembly 24 mounted on each side of the apparatus 100 may generally include a crank 46 rotatably mounted on a lower distal end of a respective active rocker link 26 at shaft 50. Each crank assembly 24 may further include a timing gear, such as a disk gear 52, fixedly secured to the shaft 50. The disk gear 52 may project into an elongate slot formed in the rocker link 26. The crank 46 and disk gear 52 are keyed to the shaft 50 to rotate together. Bearings may be disposed between the active rocker links 26 and the shaft 50 to allow the crank assemblies 24 to freely rotate relative to the active rocker links 26.

Referring again to FIG. 1, an active rocker link 26 is mounted on each side of the apparatus 100. The rocker links 26 are operatively connected to the forward stanchion 14 via a common shaft 42 rotatably secured to the forward stanchion 16 at bearing 44. Bearings may be disposed between the active rocker links 26 and the shaft 42 to allow the rocker links 26 to freely rotate relative to the shaft 42. Bearings may also be disposed between the shaft 42 and the stanchion 14 to allow the shaft 42 to freely rotate relative to the stanchion 14. Upper timing gears or sprockets 60 may be keyed to the opposite ends of the shaft 42. The flywheel 18 may also be keyed to the shaft 42 to rotate together with the shaft 42 and timing gears 60. A conventional drag strap or other known resistance device may be connected to the flywheel 18 to provide resistance to rotation.

Each disk gear 52 includes gear teeth 61 disposed about its circumference and is connected to a respective upper gear 60 by a roller chain 62 (or timing/synchronization belt) thereby maintaining synchronized rotation and nearly constant relative orientation of the left and right crank assemblies 24. The disk gears 52 may be significantly larger in diameter than the upper gears 60 and cooperate therewith to provide a stepped up flywheel arrangement. The common shaft 42 links rotation of the left crank assembly 24 to rotation of the right crank assembly 24.

The active rocker links 26 are interconnected to move in dependent fashion in opposite directions relative to one another. A cross coupler 70 is rotatably mounted on a lunge base 71 and rotatable relative thereto about a vertical axis A1. The cross coupler 70 may be rigidly mounted on a coupler hub 72. Friction disks may be disposed between the coupler hub 72 and the lunge base 71 to establish rotational resistance of the cross coupler 70. The cross coupler 70 includes ball joints 74 secured at the distal ends of the cross coupler 70. Coupler rods 76 connect the cross coupler 70 to the active rocker links 26 at respective ball joints fixedly secured proximate the upper ends of the active rocker links 26. Right and left coupler rods 76 connect respective right and left paired ball joints 74 such that the distance between right and left paired ball joints 74 remains constant.

Referring again to FIG. 2, the lunge base 71 is rotatably connected about the shaft 42 by arms 73 projecting from the lunge base 71. Bearings may be disposed between the lunge base arms 73 and the shaft 42 to allow the lunge base 71 to freely rotate relative to the shaft 42. The lunge base 71 enables the user to push/pull the handlebar rocker links 20 forward or rearward simultaneously while leaning forward or backward, respectively, while the user's feet travel in an elliptical foot path.

The apparatus 100 may include several modes of operation. It may operate in a fixed foot path length mode or in a variable foot path length mode. While in the variable foot path length mode, the range of motion experienced by a user is a function of user applied force, whereby cross coupler 70 reciprocally rotates in one direction or the other, to different degrees, dependent upon the magnitude of the user applied force. The variability of size or length of the foot path is substantial, and the foot path may be characterized as ranging from stepping motion to striding motion. In a third operational mode, the cross coupler 70 may be locked to the lunge rocker base 71, while the lunge rocker base 71 is free to pivot about the shaft 42. In this operational mode, the foot path size is constant but the location of the foot path may be movable fore and aft depending on whether the user is pushing the handlebar rocker links 20 forward or pulling them rearward while simultaneously leaning forward or backward relative to a vertical standing position while exercising. The vertical dimension of the foot path may be changed by adjusting the location of the pin 36 in the holes 37 in the intermediate regions of the force receiving member 22 or providing an actuator to change the location of the connection point of the handlebar rocker links 20 to the force receiving members 22.

Figure 3:
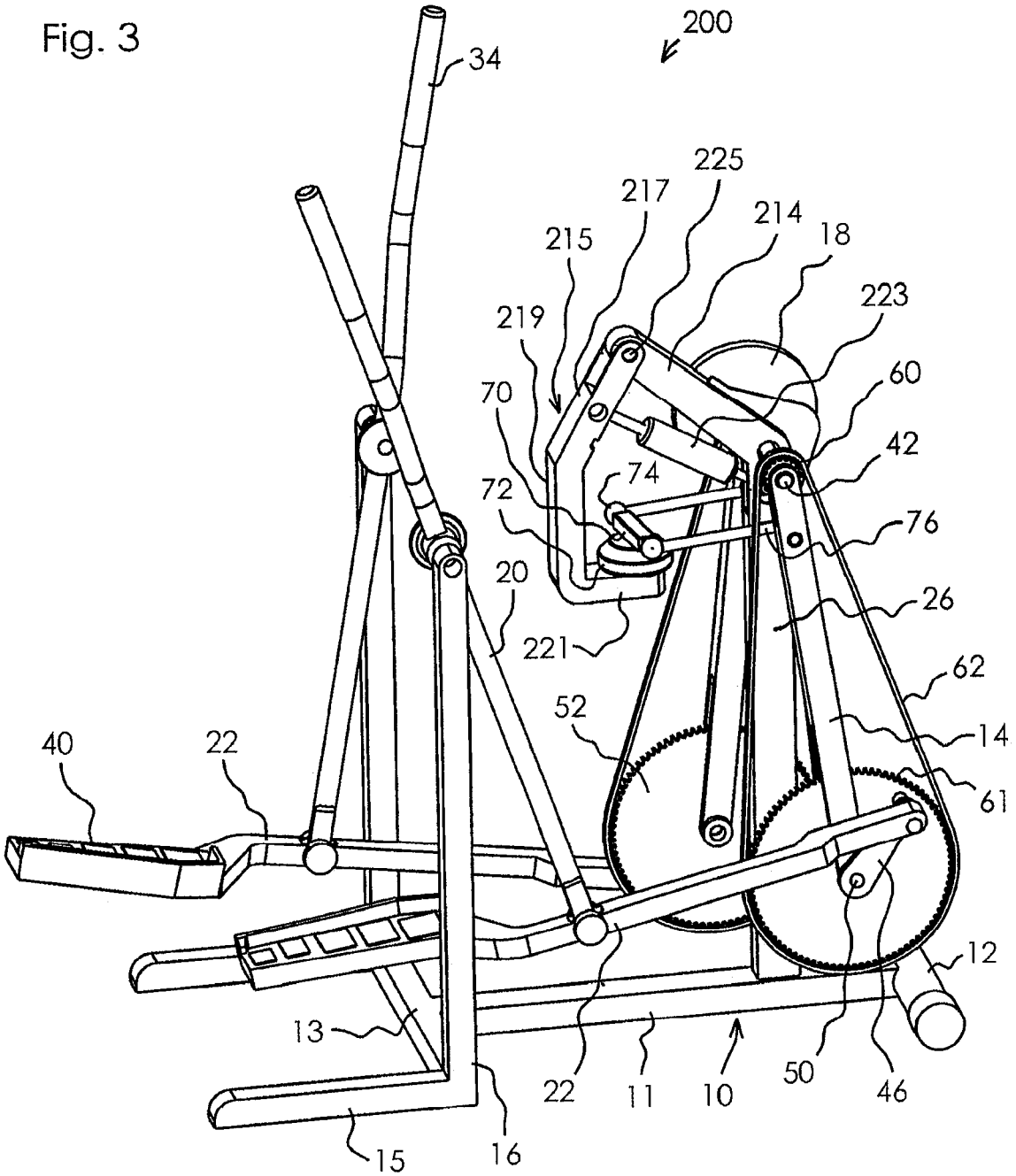
FIG. 3 is a perspective view of a second embodiment of an exercise apparatus.
Figure 4:
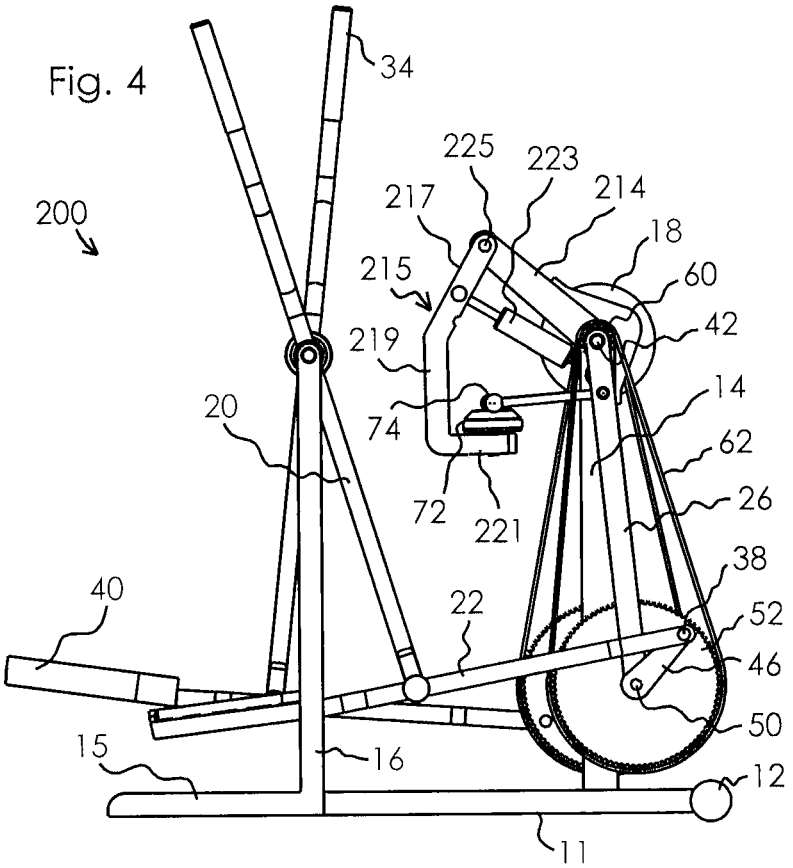
FIG. 4 is a side partial perspective view of the exercise apparatus shown in FIG. 3.
Figure 5:
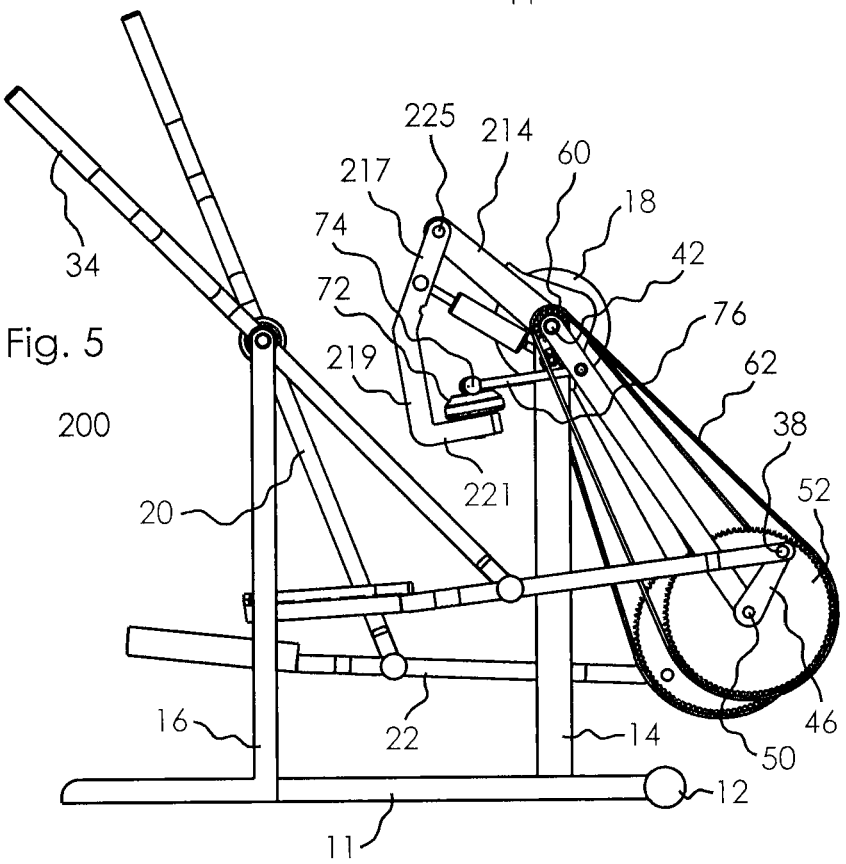
FIG. 5 is a side partial perspective view of the exercise apparatus shown in FIG. 3 depicting the exercise apparatus operating in a lunge mode.

Referring now to FIGS. 3-5, a second embodiment of an elliptical exercise apparatus is generally denoted by the reference numeral 200. The apparatus 200 is substantially the same as the apparatus 100 described above with the exception that the cross coupler 70 is rotatably connected to the forward stanchion 14. Like or corresponding reference numerals are used to designate like or corresponding parts.

The forward stanchion 14 of the apparatus 200 includes an angularly and upwardly extending portion 214 projecting generally toward the handlebar rocker links 20. An arm link 215 is pivotally connected at shaft 225 to the upper distal end of the stanchion 14. The arm link 215 may comprise an elongate body formed by arm segments 217 and 219 that define an obtuse angle θ between them. A cross coupler base 221 is secured to the lower end of the arm segment 219 or may be integrally formed with the arm link 215. The cross coupler 70 is rotatably mounted on the cross coupler base 221 and rotatable relative thereto about a vertical axis. The cross coupler 70 may be rigidly mounted on a coupler hub 72. Friction disks may be disposed between the coupler hub 72 and the base 221 to establish rotational resistance of the cross coupler 70. The cross coupler 70 includes ball joints 74 secured at the distal ends of the cross coupler 70. Coupler rods 76 connect the cross coupler 70 to the active rocker links 26 at respective ball joints fixedly secured proximate the upper ends of the active rocker links 26. Right and left coupler rods 76 connect respective right and left paired ball joints 74 such that the distance between right and left paired ball joints 74 remains constant.

A damper 223 may be interconnected between the rear stanchion 14 and an intermediate portion of the arm segment 217 of the arm link 215 to dampen relative movement therebetween. The damper 223 may operate in both directions to resist rearward and forward movement of the arm link 215. The arm link 215 enables the user to push/pull the handlebar rocker links 20 forward or rearward simultaneously while leaning forward or backward, respectively, while the user's feet travel in an elliptical foot path in a manner similar to the description above relating to the apparatus 100.

While preferred embodiments of an elliptical exercise apparatus have been shown and described, other and further embodiments of the elliptical exercise apparatus may be devised without departing from the basic scope thereof, and the scope thereof is determined by the claims which follow.

The invention claimed is:

1. An exercise apparatus, comprising:

a) a frame having a base, a stanchion extending generally vertically upward fixedly secured to the base; and b) left and right linkages each including a plurality of links, operably supported on the frame, each left and right linkages including at least:

(i) a rocker link fixedly secured to a transverse shaft rotatably connected proximate an upper distal end of the stanchion;

(ii) a crank rotatably connected proximate a lower distal end of the rocker link;

(iii) a force receiving member, wherein the force receiving member includes a forward end, an intermediate portion and a rearward end;

(iv) a handlebar rocker pivotally connected to the frame; and (v) wherein the forward end of the force receiving member is rotatably connected to the crank, a distal end of the handlebar rocker is pivotally connected at a connection point on the intermediate portion of the force receiving member, and the rearward end of the force receiving member is configured to support a user's foot constrained to move through an elliptical path.

2. The exercise apparatus of claim 1 further including a lower timing gear, wherein the lower timing gear and the crank are keyed to a common shaft rotatably connected proximate the lower distal end of the rocker link, and further including an upper timing gear fixedly secured proximate an end of the transverse shaft and a timing belt connecting the upper timing gear to the lower timing gear.

3. The exercise apparatus of claim 1 further including a cross-coupler assembly, the cross-coupler assembly including a coupler link fixedly secured to a coupler hub, and further including a coupler rod interconnected between the coupler link and the rocker link.

4. The exercise apparatus of claim 3 wherein the cross-coupler assembly is selectively locked between a variable foot path mode and a fixed foot path mode.

5. The exercise apparatus of claim 3 wherein the cross-coupler assembly is mounted on an arm link pivotally connected to a distal end of the stanchion, and further including a damper interconnected between the stanchion and the arm link resisting rearward and forward movement of the arm link.

6. The exercise apparatus of claim 1 wherein the connection point of the handlebar rocker is adjustable along the intermediate portion of the force receiving member.

7. The exercise apparatus of claim 1 wherein the elliptical path is variable as a function of user applied force.

8. The exercise apparatus of claim 1 wherein a user may change the location of the elliptical path fore or aft relative to the frame by pushing/pulling the handlebar rocker while simultaneously leaning forward or backward relative to a vertical standing position while exercising.

9. An exercise apparatus, comprising:

a) a frame; and b) left and right linkages including a plurality of links operably supported on the frame, the left and right linkages including at least:

(i) a rocker link pivotally connected to the frame;

(ii) a crank rotatably connected proximate a lower end of the rocker link;

(iii) a force receiving member, wherein the force receiving member includes a forward end, an intermediate portion and a rearward end;

(iv) a handlebar rocker pivotally connected to the frame;

(v) an upper timing gear fixedly movably connected to the frame, the upper timing gear operatively connected to a lower timing gear rotatably connected proximate the lower end of the rocker link; and (vi) wherein the forward end of the force receiving member rotatably connected to the crank, a distal end of the handlebar rocker pivotally connected at a connection point on the intermediate portion of the force receiving member, and the rearward end of the force receiving member configured to support a user's foot constrained to move through an elliptical path.

10. An exercise apparatus, comprising:

a) a frame including a base and a generally vertically upwardly extending stanchion fixedly secured to said base;

b) a left rocker link and a right rocker link fixedly secured to a transverse shaft rotatably connected proximate an upper distal end of said stanchion;

c) a left crank and a right crank rotatably connected proximate a lower end of a respective said left rocker link and said right rocker link;

d) a left handlebar and a right handlebar pivotally connected to a respective side of said frame;

e) a left foot support member and a right foot support member rotatably connected to a respective said left crank and said right crank; and f) a left upper timing gear and a right upper timing gear fixedly secured to opposite ends of said transverse shaft, said left upper timing gear and said right upper timing gear operatively connected to a respective left lower timing gear and right lower timing gear rotatably connected proximate a lower end of a respective said left rocker link and said right rocker link.

11. The exercise apparatus of claim 10 wherein each said left foot support member and said right foot support member includes a forward end and a rearward end, said left handlebar and said right handlebar pivotally connected between said forward end and said rearward end of a respective said left foot support member and said right foot support member, wherein said rearward end of a respective said left foot support member and said right foot support member is configured to support a user's foot constrained to move through a respective elliptical path.

12. The exercise apparatus of claim 10 wherein said left crank and said right crank and a respective said left lower timing gear and said right lower timing gear are keyed to a common shaft rotatably connected to a respective said left rocker link and said right rocker link.

13. The exercise apparatus of claim 10 further including a cross connect link pivotally connected to said frame interconnecting said left handlebar and said right handlebar for synchronized movement of said left foot support member and said right foot support member.

14. The exercise apparatus of claim 13 wherein said cross connect link is mounted to an arm link pivotally connected to said stanchion, and further including a damper interconnecting said stanchion and said arm link.

15. The exercise apparatus of claim 10 wherein said left handlebar and said right handlebar are pivotally connected at a connection point adjustable along a respective said left foot support member and said right foot support member.

* * * * *